US005669863A

United States Patent [19]

Ho

[11] Patent Number: 5,669,863

[45] Date of Patent: Sep. 23, 1997

[54] LEG EXERCISING APPARATUS

[76] Inventor: Sung-Chao Ho, 3E45, No. 5, Sec. 5, Hsin Yi Road, Taipei, Taiwan

[21] Appl. No.: 670,217

[22] Filed: Jun. 21, 1996

[51] Int. Cl.[6] ..... A63B 21/02

[52] U.S. Cl. ..... 482/129; 482/125; 482/123

[58] Field of Search ..... 482/121, 122, 482/124, 125, 129, 123

[56] References Cited

U.S. PATENT DOCUMENTS

| | | | |
|---|---|---|---|
| 189,539 | 4/1877 | Wood | 482/129 |
| D. 256,822 | 9/1980 | Ozzimo | 482/129 |
| 5,385,525 | 1/1995 | Davis | 482/129 |
| 5,407,404 | 4/1995 | Killian et al. | 482/123 |

*Primary Examiner*—Lynne A. Reichard
*Attorney, Agent, or Firm*—Bacon & Thomas

[57] ABSTRACT

A compact leg exerciser adapted for use at home includes a retractable support bar having a suction disk at a bottom end and a handle bar at a top end, a linking-up bar having a foot rest at one end which is connected to the support bar by means of a resilient bar or spring, the linking-up bar having the other end locked to the bottom end of the support bar. In use, the suction disk of the support bar is caused to hold firmly onto the floor, keeping the support bar in an upright position. The user may grip the handle bar of the support bar and rest his/her feet on the foot rest. With the arrangement of the resilient band or spring, the user may exercise the leg muscles by extending his/her feet to push the foot rest forwardly and then relaxing.

3 Claims, 3 Drawing Sheets

LEG EXERCISING APPARATUS

BACKGROUND OF THE INVENTION (a) Field of the Invention

The present invention relates generally to an exercising apparatus, and more particularly to a collapsible and compact leg exerciser adapted for use at home.

(b) Description of the Prior Art

People are paying more and more attention to their health nowadays, and exercising apparatuses are very popular. However, many exercising apparatuses are bulky and are not suitable for use at home. Besides, they are also expensive.

SUMMARY OF THE INVENTION

Accordingly, a primary object of the present invention is to provide a collapsible and compact leg exerciser to eliminate the drawbacks with the prior art.

In order to achieve the aforementioned object, the leg exerciser according to the present invention essentially comprises a support bar having a suction disk at a bottom end and a handle bar at a top end, a linking-up bar having one end locked to the bottom end of the support bar and the other end provided with a foot rest and connected to the support bar by means of a resilient band or spring. In use, the support bar is arranged in an upright position by adhering the suction disk firmly to the floor. Due to the arrangement of the resilient band or spring, the user may, while gripping the handle bar of the support bar, push the foot rest forwardly with both feet and then relax in a repeated pattern to exercise the leg muscles.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
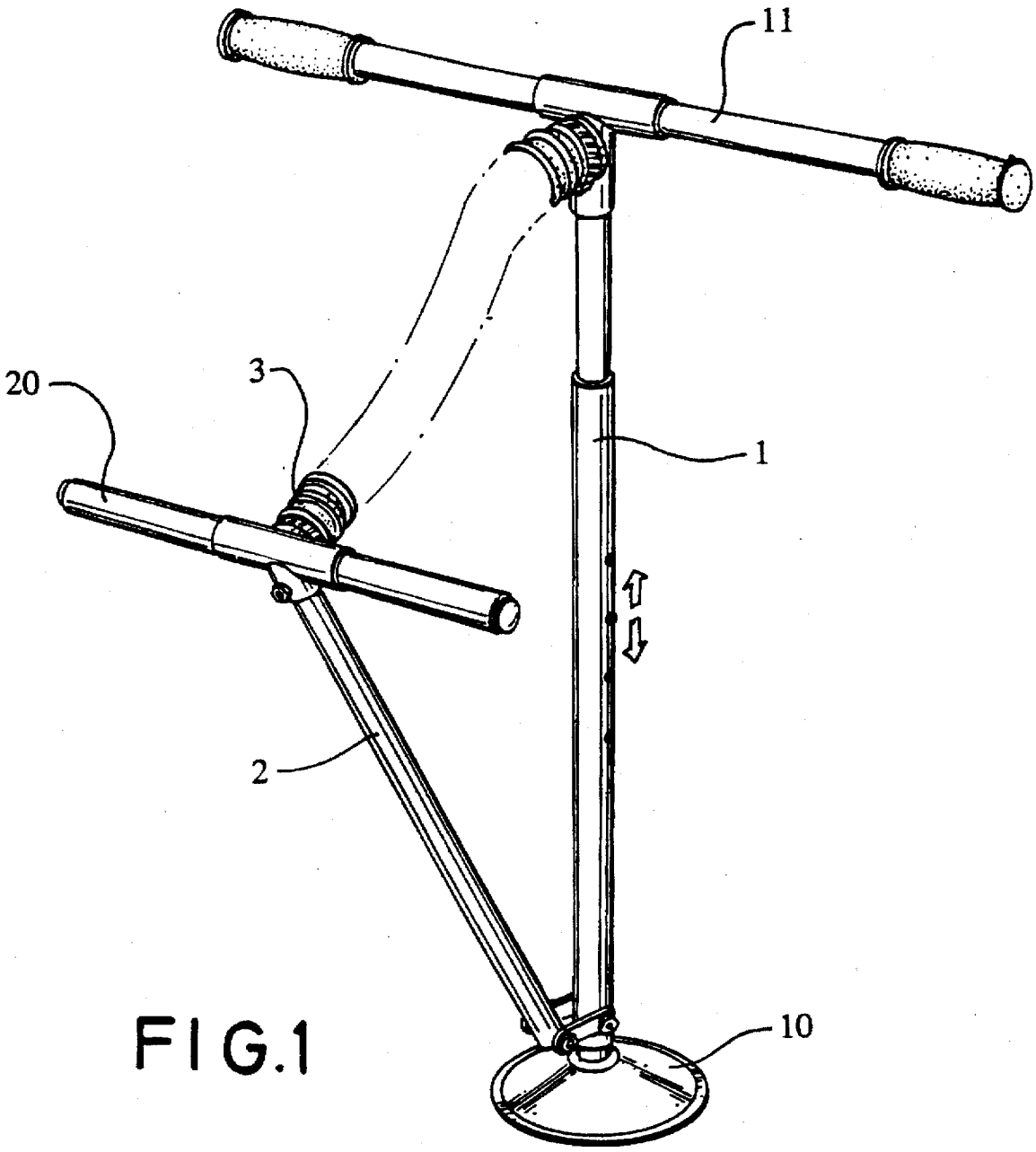
FIG. 1 is an elevational view of a preferred embodiment of the present invention.
Figure 2:
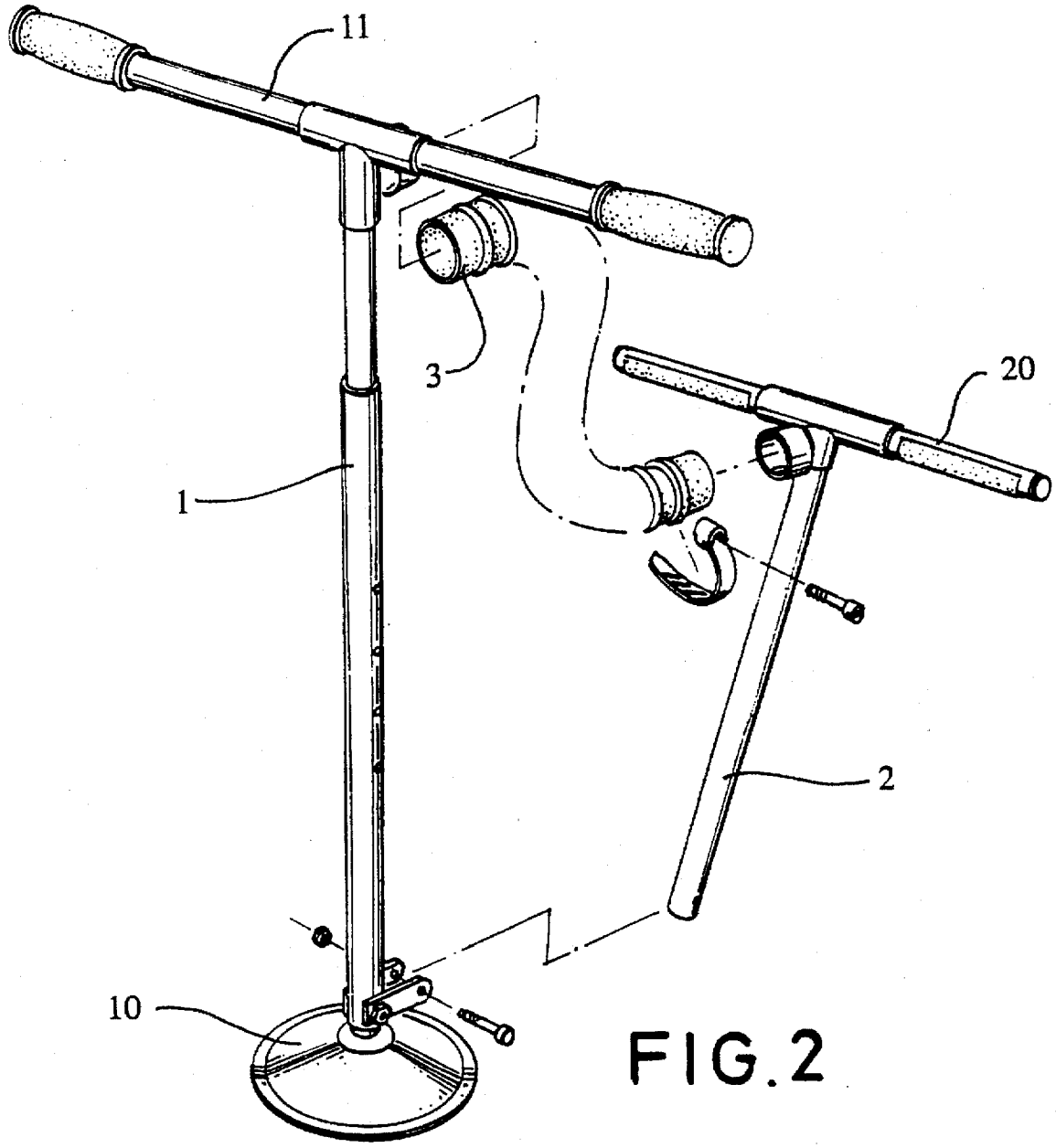
FIG. 2 is an exploded elevational view of the preferred embodiment of the present invention.

With reference to the drawings, the present invention essentially comprises a support bar 1, a linking-up bar 2 and a resilient belt or spring 3. The support bar 1 is an adjustable and retractable bar structure. In the embodiment shown in the drawings, it is illustrated that a resilient fastener is used to engage a hole to achieve adjustment of the support bar 1. It should be noted that there are many examples of conventional retractable bars, such as the retractable legs of camera tripods. Thus, the construction of the support bar 1 will not be described in detail hereinafter. The support bar 1 is provided with a suction disk 10 at a bottom end thereof and a horizontal handle bar 11 at an upper end thereof. The linking-up bar 2 has one end pivotally connected to the bottom end of the support bar 1 at a proper position and the other end provided with a foot rest 20. That other end is locked to the upper end of the support bar 1 by means of the resilient band or spring 3.

Figure 3:
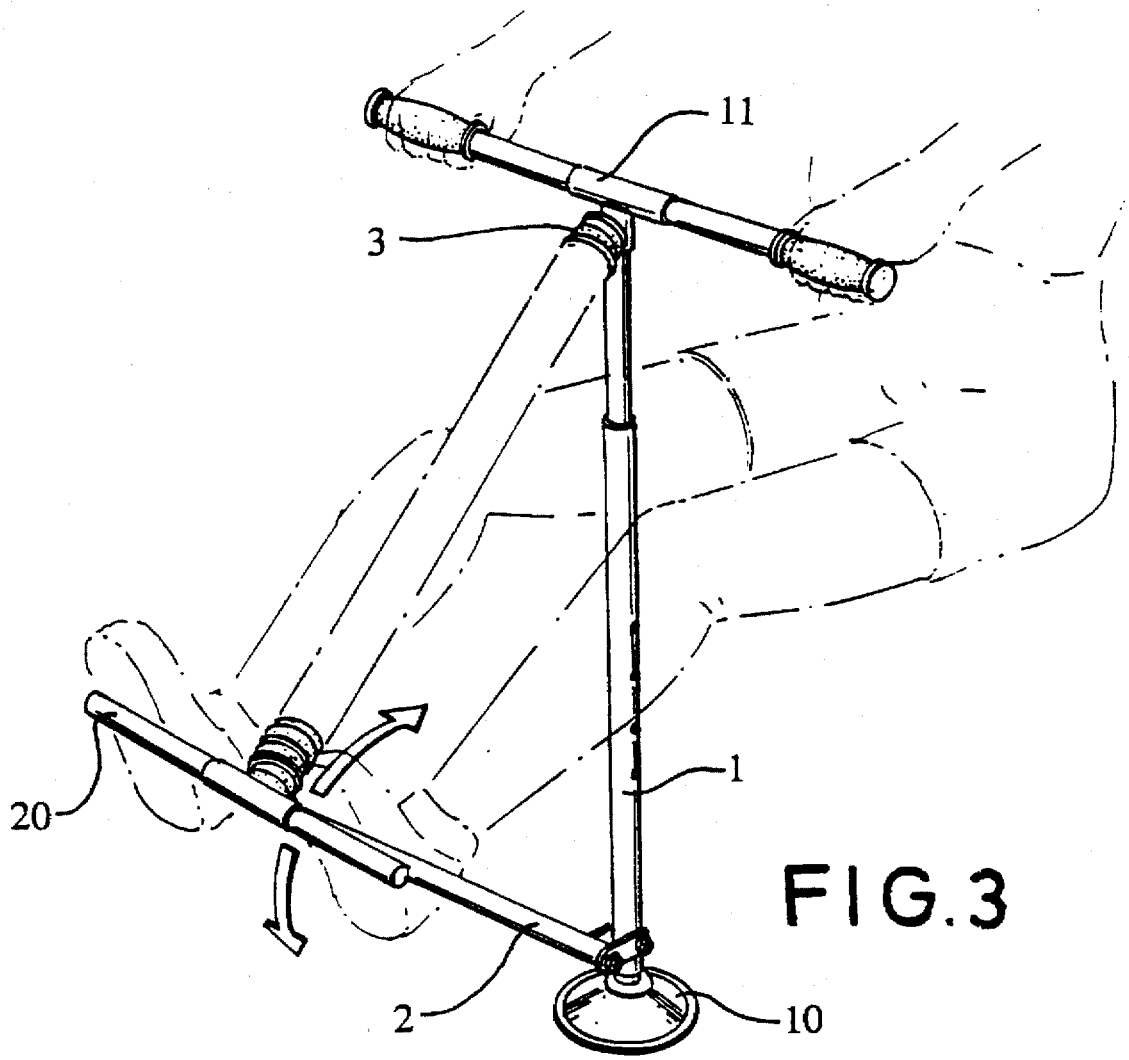
FIG. 3 is a schematic view of the preferred embodiment of the present invention in use.

Referring to FIG. 3, in actual use, the user may sit on a chair and adjust the height of the support bar 1 before pressing the suction disk 10 firmly onto the floor surface. Then the user may hold the handle bar 11 to cause the support bar 1 to be in a substantially upright position. With both feet resting on the foot rest 20 and both hands gripping the handle bar 11, the user may exercise his/her feet by extending both feet to press the foot rest 20 forwardly and then relaxing. Due to the arrangement of the resilient band or spring 3 connecting the support bar 1 and the linking-up bar 2, the linking-up bar 2 may use the pivotal joint between its bottom end and the bottom end of the support bar 1 as a pivot to swing back and forth, so that the user may exercise his/her feet.

When not in use, the user may simply slant the support bar to one side so that the suction disk 10 may be lifted from the floor. The linking-up bar 2 may be pushed towards the support bar 1 so that they may be stored or put aside neatly. Such a compact and collapsible construction will not occupy space and may be easily mounted for use.

Although the present invention has been illustrated and described with reference to the preferred embodiment thereof, it should be understood that it is in no way limited to the details of such embodiment but is capable of numerous modifications within the scope of the appended claims.

What is claimed is:

1. A leg exerciser for use by a person in a seated position comprising:

a) a single support bar having a top end and a bottom end, the single support bar being adjustable in length such that the distance between the top end and the bottom end is adjustable;

b) a single linking-up bar having a first end pivotally connected to the single support bar adjacent to the bottom end of the single support bar, the single linking-up bar having a second end;

c) a handlebar attached to, and extending laterally from the top end of the single support bar such that the handlebar and the support bar form a first substantially "T"-shaped assembly;

d) a foot rest attached to and extending laterally from the second end of the linking-up bar such that the foot rest and the linking-up bar form a second substantially "T"-shaped assembly;

e) a suction disk attached to the bottom end of the support bar for releasably attaching the single support bar to a floor; and, f) a resilient member connected to the top end of the single support bar adjacent to the handlebar and to the second end of the linking-up bar, whereby movement of the second end of the linking-up bar away from the single support bar causes the resilient member to resiliently expand.

2. The leg exerciser as claimed in claim 1, wherein said resilient member comprises a resilient band.

3. The leg exerciser as claimed in claim 1, wherein said resilient member comprises a spring.

* * * * *